US012247461B2

(12) United States Patent
Bremner

(10) Patent No.: US 12,247,461 B2
(45) Date of Patent: Mar. 11, 2025

(54) PROCESS CONTROL SYSTEM AND METHOD FOR OIL AND/OR GAS PRODUCTION AND TRANSPORTATION SYSTEMS

(71) Applicant: Blue Gentoo Ltd, Ellon (GB)

(72) Inventor: Phil Bremner, Inverurie (GB)

(73) Assignee: Blue Gentoo Ltd, Ellon (GB)

( * ) Notice: Subject to any disclaimer, the term of this patent is extended or adjusted under 35 U.S.C. 154(b) by 762 days.

(21) Appl. No.: 17/276,874

(22) PCT Filed: Sep. 17, 2019

(86) PCT No.: PCT/GB2019/052621
§ 371 (c)(1),
(2) Date: Mar. 17, 2021

(87) PCT Pub. No.: WO2020/058704
PCT Pub. Date: Mar. 26, 2020

(65) Prior Publication Data

US 2022/0049580 A1 Feb. 17, 2022

(30) Foreign Application Priority Data

Sep. 17, 2018 (GB) ..... 1815139

(51) Int. Cl.
*E21B 37/06* (2006.01)
*E21B 43/01* (2006.01)
(Continued)

(52) U.S. Cl.
CPC ..... *E21B 37/06* (2013.01); *E21B 43/12* (2013.01); *E21B 47/07* (2020.05); *E21B 47/10* (2013.01);
(Continued)

(58) Field of Classification Search
None
See application file for complete search history.

(56) References Cited

U.S. PATENT DOCUMENTS 6,851,444 B1 2/2005 Kohl et al.
8,575,541 B1 * 11/2013 Jamison ..... E21B 21/08 250/253

(Continued)

OTHER PUBLICATIONS

International Search Report and Written Opinion for Application No. PCT/GB2019/052621, dated Jan. 20, 2020, 10 pages.

*Primary Examiner* — John J Figueroa
(74) *Attorney, Agent, or Firm* — McCarter & English, LLP; Yu Lu

(57) ABSTRACT

A process control system for use in an oil and/or gas production and/or transportation system, comprises a controller configured to receive an input signal comprising measurement data relating to a production fluid flow in an oil and/or gas production and/or transportation system. The controller is configured to determine from the received input signal an adjustment in the configuration of a flow control arrangement of the production, and provide an output signal indicative of the adjustment in the configuration of the flow control arrangement. The system is configured to mitigate the formation of gas hydrates and/or the accumulation of paraffin wax, asphaltenes or other solids in an oil and/or gas production and/or transportation system by adjusting the flow control arrangement to vary the injection of a chemical into the production and/or transportation system.

29 Claims, 5 Drawing Sheets

(51) Int. Cl.

| | |
|---|---|
| ***E21B 43/12*** | (2006.01) |
| ***E21B 47/07*** | (2012.01) |
| ***E21B 47/10*** | (2012.01) |
| ***E21B 49/08*** | (2006.01) |

(52) U.S. Cl.
CPC ..... *E21B 49/0875* (2020.05); *E21B 43/01* (2013.01); *E21B 2200/02* (2020.05); *E21B 2200/22* (2020.05)

(56) References Cited

U.S. PATENT DOCUMENTS

| | | | | |
|---|---|---|---|---|
| 2004/0168811 | A1 | 9/2004 | Shaw et al. | |
| 2005/0166961 | A1 | 8/2005 | Means et al. | |
| 2014/0166871 | A1* | 6/2014 | Jamison ..... | E21B 49/08 250/254 |
| 2016/0305223 | A1* | 10/2016 | Phillippi ..... | F04D 13/12 |
| 2017/0247986 | A1 | 8/2017 | Bussell et al. | |
| 2021/0123551 | A1* | 4/2021 | Kuhn De Chizelle . | F16L 41/03 |

* cited by examiner

PROCESS CONTROL SYSTEM AND METHOD FOR OIL AND/OR GAS PRODUCTION AND TRANSPORTATION SYSTEMS

CROSS-REFERENCE TO RELATED APPLICATIONS

This application is a U.S. national stage filing, under 35 U.S.C. § 371 (c), of International Application No. PCT/GB2019/052621, filed on Sep. 17, 2019, which claims priority to United Kingdom Patent Application No. 1815139.9, filed on Sep. 17, 2018. The entire contents of each of the aforementioned applications are incorporated herein by reference.

FIELD

This relates to a process control system and method for use in an oil and/or gas production and/or transportation system, and more particularly but not exclusively to a process control system and method for use in gas hydrate management and/or paraffin wax management in an oil and/or gas production and/or transportation system.

BACKGROUND

In order to access a hydrocarbon bearing formation containing an oil and/or gas reservoir, a well borehole ("wellbore") is drilled from surface and the wellbore lined with sections of metal bore-lining tubing, commonly known as casing. Following completion of the wellbore, production fluid, e.g. oil and/or gas from the reservoir, is allowed to enter the wellbore which transports the production fluid towards surface. In order to control production from a given wellbore, a flow control arrangement including a valve arrangement known as a tree is typically located on the wellhead. The valve arrangement comprises a number of flow control valves and safety valves configured to control production fluid flow and/or facilitate well isolation. The valve arrangement also controls access into the wellbore for tools, equipment, and fluid. In subsea environments, for example, the production fluid flow is typically transported from one or more wellhead at the seabed to a surface facility—such as a fixed or floating platform, a vessel (e.g. FPSO unit) or the like—via one or more subsea jumper, flowline, pipeline, umbilical, riser or the like.

It will be recognised that the successful and economic operation of a given wellbore involves a significant number of technical challenges. For example, one major challenge in the industry is the formation of gas hydrates, i.e., ice-like solids that can form wherever gas meets water at high pressure and low temperature, including for example in said subsea jumpers, flowlines, pipelines, umbilicals, and/or risers.

A number of techniques are employed to mitigate the formation of gas hydrates in oil and/or gas production and/or transportation systems. For example, for larger subsea fields operators may employ trace heating techniques in which a heating element is run along a length of the tubing (e.g. jumpers, flow lines, umbilicals, risers and the like) to raise the temperature and thereby prevent or reduce gas hydrate formation. Alternatively, or additionally, operators will mitigate the risk of gas hydrate formation by continuous injection of chemical inhibitors, e.g. Thermodynamic Hydrate Inhibitors (THIs) or Low Dosage Hydrate Inhibitors (LDHIs) such as methanol or monoethylene glycol (MEG) or others. Another significant challenge faced by operators is the accumulation of paraffin wax, asphaltenes and other solid materials in the wellbore, which over time inhibit production fluid flow to surface and, as with gas hydrates, conventional management techniques include injection of chemicals into the production and/or transportation systems. However, conventional techniques and methodologies typically result in unnecessary overdosing of chemicals, reducing the efficacy of the production and/or transportation systems.

SUMMARY

According to a first aspect, there is provided a process control system for use in an oil and/or gas production, transportation and/or storage system, comprising:

- a controller configured to receive an input signal comprising measurement data relating to a production fluid flow in an oil and/or gas production, transportation and/or storage system,
- the controller configured to determine from the received input signal an adjustment in the configuration of a flow control arrangement of the production, transportation and/or storage system,
- wherein the controller is configured to provide an output signal indicative of the adjustment in the configuration of the flow control arrangement.

In particular embodiments, the system may be configured to mitigate the formation of gas hydrates, clathrates and/or the accumulation of paraffin wax, asphaltenes or other solids in an oil and/or gas production, transportation and/or storage system by adjusting the flow control arrangement to vary the injection of a chemical into the production, transportation and/or storage system.

In the case of gas hydrates for example the system may be configured to provide an output signal indicative of an adjustment to the flow control arrangement to vary the injection of THIs or LDHIs (methanol or monoethylene glycol (MEG) or other chemical) into the production, transportation and/or storage system.

In the case of paraffin wax, asphaltenes and the like, the system may be configured to provide an output signal indicative of an adjustment to the flow control arrangement to vary the injection of a solvent, such as diesel, kerosene or other suitable material.

The system may be configured to provide an output signal indicative of an adjustment to the flow control arrangement to vary the injection of a kinetic inhibitor.

The system may be configured to provide an output signal indicative of an adjustment to the flow control arrangement to vary the injection of an anti-agglomerant.

Beneficially, embodiments of the system may permit oil and/or gas production, transportation and/or storage operations to be managed more efficiently than conventional techniques and methodologies which rely on manual control. Moreover, embodiments of the system may reduce the environmental impact on the surrounding environment, for example by reducing or eliminating the waste due to overuse of chemicals used in gas hydrate management and/or paraffin wax management operations, and the associated equipment footprint.

As described above, the process control system is operatively associated with an oil and/or gas production, transportation and/or storage system.

The production, transportation and/or storage system may comprise a jumper for transporting production fluid.

The production, transportation and/or storage system may comprise a flow line for transporting production fluid.

The production, transportation and/or storage system may comprise a riser.

The production, transportation and/or storage system may comprise a pipeline.

The production, transportation and/or storage system may comprise an umbilical.

The production, transportation and/or storage system may comprise part of an oil and/or gas production wellbore. For example, the process control system may be configured to control the formation of gas hydrates which may otherwise occur above the subsurface safety valve of the production wellbore. Alternatively or additionally, the process control system may be configured to control the formation of paraffin wax, asphaltenes and the like which may otherwise occur in the production wellbore.

The production, transportation and/or storage system may comprise a surface facility.

The surface facility may comprise or take the form of a fixed platform.

The surface facility may comprise or take the form of a floating platform.

The surface facility may comprise or take the form of a vessel, e.g. FPSO unit or the like.

The system may comprise, may be coupled to, or operatively associated with the flow control arrangement.

The flow control arrangement may comprise a production tree.

The production tree may comprise a Christmas tree.

The production tree may comprise a subsea tree.

In particular embodiments, the production tree may comprise a subsea Christmas tree.

As described above, the input signal comprises measurement data relating to a production fluid flow in an oil and/or gas production, transportation and/or storage system.

The measurement data may comprise fluid flow data.

The system may comprise, may be coupled to, or operatively associated with, a fluid flow meter.

The fluid flow meter may comprise a multi-phase flow meter.

Alternatively, or additionally, the fluid flow meter may comprise a wet gas flow meter.

The fluid flow meter may form part of the flow control arrangement, e.g. tree.

The measurement data may comprise fluid composition data.

For example, the measurement data may comprise information relating to the water fraction.

The system may comprise, may be coupled to, or operatively associated with a water fraction meter.

The water fraction meter may form part of the flow control arrangement, e.g. tree.

The measurement data may comprise data relating to a condition in the wellbore and/or the production fluid.

The system may comprise, may be coupled to, a sensor arrangement.

The sensor arrangement may form part of the flow control arrangement, e.g. tree.

The sensor arrangement may comprise a temperature sensor.

The temperature sensor may be configured to measure the temperature in the production, transportation and/or storage system and/or the production fluid flow.

The temperature sensor may form part of the flow control arrangement, e.g. tree.

The sensor arrangement may comprise a pressure sensor.

The pressure sensor may be configured to measure the temperature in the production, transportation and/or storage system and/or the production fluid flow.

The pressure sensor may form part of the flow control arrangement, e.g. tree.

The input signal may comprise real time data.

The input signal may further comprise data relating to a simulated condition in the wellbore.

The input signal may further comprise data from conventional manually controlled monitoring systems and equipment.

The input signal may comprise data from a range of specialist monitoring, analysis, and/or predictive units.

The controller may be configured to determine the adjustment in the configuration of a flow control arrangement of the production wellbore by combining the measurement data, in particular but not exclusively real time measurement data, with the data from the specialist monitoring, analysis, and predictive units.

The system may be configured to operate autonomously.

The controller may be configured to determine the adjustment in the configuration of the flow control arrangement using an artificial intelligence algorithm.

In use, the system may be configured to arrange and organise data, extract patterns and detect trends that are too complex and/or subtle to be detected by humans or by current computerised techniques. The system is capable of automatically devising optimal operational strategies (such as those for hydrate formation prevention) which can either be implemented by the system or passed to a human operator for approval. Moreover, the system is capable of learning operator decisions on the proposed strategies and operator defined changes to any proposed steps, using changes automatically verified as successful to automatically improve the existing strategies. This process may identify human decisions resulting in the deterioration of operating conditions, use this knowledge to avoid such decisions being reused, and flag them to the human decision makers in future operations.

In some embodiments, the system may be configured to adjust in response to a control command from an operator. The control command may comprise or take the form of an override command. Beneficially, embodiments of the system permit autonomous operation while also permitting manual intervention where required.

As described above, the controller is configured to provide an output signal indicative of the adjustment in the configuration of the flow control arrangement.

The output signal may comprise chemical metering data.

The system may comprise, may be coupled to, or may be operatively associated with a chemical injection metering valve (CIMV).

The output signal may comprise chemical metering data from the chemical injection metering valve (CIMV).

The system may be configured to report/advise, e.g. through reasoning or other suitable means, whether the meter is fully compliant to the signal it is receiving.

The meter may also comprise diagnostics software within its control software.

The chemical injection metering valve (CIMV) may form part of the flow control arrangement, e.g. production tree, manifold, or other component of the system.

The output signal may comprise an adjustment to the chemical injection metering valve.

The system may comprise, may be coupled to, or operatively associated with a chemical injection arrangement.

The chemical injection arrangement may comprise one or more flow line.

Where a plurality of flow lines are provided, the flow lines can be separate or bundled together in an umbilical or bundle.

The flow lines may be configured to compensate for losses. The flow lines may be configured to feed a whole field, e.g. in the event of equipment failure, line blockage or failure.

The chemical injection arrangement may comprise a chemical store. The chemical store may be coupled to the flow control arrangement, e.g. production tree, by the one or more flow line.

The chemical store may be located at a distal location relative to the flow control arrangement.

The chemical store may be located at surface. In the case of a subsea wellbore, the chemical store may be located at surface, such as on a surface vessel, platform or the like.

Alternatively, or additionally, the chemical store may be located onboard the flow control arrangement, or on a remotely operated vehicle or the like.

The output signal may comprise choke control data.

The system may comprise, may be coupled to, or operatively associated with a valve.

The valve may be configured to send a signal indicative of the configuration of the valve, e.g. the position that the valve is open in or % aspect of the whole travel from 0-100%.

The valve may comprise or take the form of a hydraulic valve

The valve may comprise or take the form of a hydraulic stepping valve.

The valve may comprise or take the form of an electric and/or electro-mechanical valve.

The valve may comprise or may be operatively associated with a linear actuator.

The valve may comprise or may be operatively associated with a variable speed by frequency inverter.

The valve may comprise or may be operatively associated with a linear variable differential transformer (LVDT). Beneficially, the valve provides a high degree of control and precision in its operation and controllability.

The system may comprise, may be coupled to, or operatively associated with a choke valve.

The choke may comprise a DC choke valve.

More particularly, but not exclusively, the choke valve may comprise the choke valve of a production tree, such as a subsea Christmas tree.

The system may comprise, may be coupled to, or may be operatively an actuator arrangement.

The actuator arrangement may be configured to operate the valve, e.g. the choke valve.

The actuator arrangement may comprise or take the form of a hydraulic actuator arrangement.

The actuator arrangement may comprise or take the form of an electric and/or electro-mechanical actuator arrangement. The choke valve may be located at any suitable location.

The choke valve may be located on the tree.

Alternatively, the choke valve may be located at surface, e.g. on the topside riser balcony.

The actuator arrangement may be modular in construction. Beneficially, the provision of a modular actuator arrangement facilitates retrieval of components back to surface in the event of failure.

The system may comprise, may be coupled to or operatively associated a safety valve. The safety valve may take the form of a SCSV.

In use, the system controls the amount of chemical, e.g. MEG, that is injected into the flow stream of hydrocarbon production flow by the chemical injection metering valve situated on the production tree. The system may be configured to improve and/or optimise the volume of injected chemical.

The system may be configured to communicate data to a data historian system. In use, this function enables data analysts to review and become more aware of any trends in the production process.

The system may be at least partially located on the production tree.

Alternatively, the system may be at least partially located on the surface facility, e.g. floating or fixed platform, vessel or the like. In particular but not exclusively, the system may be at least partially located on or in a process control area of the surface facility.

The system may be coupled to or operatively associated with a control panel or other control system interface on the surface facility. In use, an operator may be able to monitor data being streamed from the sensor arrangement and/or the production, transportation and/or storage system, e.g. pipelines, flowlines, riser or the like.

According to a second aspect, there is provided an oil and/or gas production, transportation and/or storage system comprising the process control system of the first aspect.

According to a third aspect, there is provided a process control method for use in an oil and/or gas production, transportation and/or storage system, comprising:

- receiving an input signal comprising measurement data relating to a production fluid flow in an oil and/or gas production, transportation and/or storage system and/or transportation system;
- determining from the received input signal an adjustment in the configuration of a flow control arrangement of the production, transportation and/or storage system and/or transportation system; and
- providing an output signal indicative of the adjustment in the configuration of the flow control arrangement.

Beneficially, embodiments of the method may permit operations to be managed more efficiently than conventional techniques and methodologies which rely on manual control. Moreover, embodiments of the method may reduce the environmental impact on the surrounding environment, for example by reducing or eliminating the waste due to overuse of chemicals used in gas hydrate management and/or paraffin wax management operations, and the associated equipment footprint.

The process control method may employ the system according to the first aspect and features defined above with respect to the first aspect may also apply to the second aspect, and vice-versa.

The method may comprise the step of adjusting the configuration of the flow control arrangement.

The method may comprise operating the system according to the adjusted configuration.

The method may be implemented in software. The software may employ deep reasoning and learning techniques.

The method may comprise operating the system according to the adjusted configuration to generate a second measurement data set.

The method may comprise determining, from the acquired second data set, a further adjustment to the flow control arrangement.

The active adjustment of the flow control arrangement may be repeated to acquire a series of data sets, each of which is obtained under circumstances optimised according to the input data.

Accordingly, the conditions relative to which the configuration of the flow control arrangement is to be improved or optimised may be assessed continuously or at intervals.

Adjusting the configuration of the flow control arrangement may be carried out after each operation.

Adjusting the configuration of the flow control arrangement may be carried out after a selected number of operations.

Adjusting the configuration of the flow control arrangement may be carried out where the determined adjustment exceeds a selected threshold.

The method may operate automatically and independently to optimise the production process.

The method may operate fully autonomously, partially autonomously, partially manually or fully manually, e.g. in a bypass or override mode, at a given time during operation.

Beneficially, embodiments of the system and method provide a real time monitoring system and methodology for oil and gas production operations, in contrast to conventional production operation control which are based on manually controlled and balanced flow streams from reservoirs that may involve a complex array of different pressures and temperature characteristics.

According to another aspect, there is provided a processing system configured to implement one or more of the previous aspects.

The processing system may comprise at least one processor. The processing system may comprise and/or be configured to access at least one data store or memory. The data store or memory may comprise or be configured to receive operating instructions or a program specifying operations of the at least one processor. The at least one processor may be configured to process and implement the operating instructions or program.

The at least one data store may comprise, and/or comprise a reader, drive or other means configured to access, optical storage or disk such as a CD or DVD, flash drive, SD device, one or more memory chips such as DRAMs, a network attached drive (NAD), cloud storage, magnetic storage such as tape or magnetic disk or a hard-drive, and/or the like.

The processing system may comprise a network or interface module. The network or interface module may be connected or connectable to a network connection or data carrier, which may comprise a wired or wireless network connection or data carrier, such as a data cable, powerline data carrier, Wi-Fi, Bluetooth, Zigbee, internet connection or other similar connection. The network interface may comprise a router, modem, gateway and/or the like. The system or processing system may be configured to transmit or otherwise provide the audio signal via the network or interface module, for example over the internet, intranet, network or cloud.

The processing system may comprise a processing apparatus or a plurality of processing apparatus. Each processing apparatus may comprise at least a processor and optionally a memory or data store and/or a network or interface module. The plurality of processing apparatus may communicate via respective network or interface modules. The plurality of processing apparatus may form, comprise or be comprised in a distributed or server/client based processing system.

According to another aspect, there is provided a computer program product configured such that when processed by a suitable processing system configures the processing system to implement one or more of the previous aspects.

The computer program product may be provided on or comprised in a carrier medium. The carrier medium may be transient or non-transient. The carrier medium may be tangible or non-tangible. The carrier medium may comprise a signal such as an electromagnetic or electronic signal. The carrier medium may comprise a physical medium, such as a disk, a memory card, a memory, and/or the like.

According to another aspect, there is provided a carrier medium, the carrier medium comprising a signal, the signal when processed by a suitable processing system causes the processing system to implement one or more of the previous aspects.

It will be well understood by persons of ordinary skill in the art that whilst some embodiments may implement certain functionality by means of a computer program having computer-readable instructions that are executable to perform the method of the embodiments. The computer program functionality could be implemented in hardware (for example by means of a CPU or by one or more ASICs (application specific integrated circuits)) or by a mix of hardware and software.

Whilst particular pieces of apparatus have been described herein, in alternative embodiments, functionality of one or more of those pieces of apparatus can be provided by a single unit, processing resource or other component, or functionality provided by a single unit can be provided by two or more units or other components in combination. For example, one or more functions of the processing system may be performed by a single processing device, such as a personal computer or the like, or one or more or each function may be performed in a distributed manner by a plurality of processing devices, which may be locally connected or remotely distributed.

It should be understood that any of the features defined above or which are described below in relation to any specific embodiment may be utilised, either alone or in combination with any other defined feature.

BRIEF DESCRIPTION OF THE DRAWINGS

These and other aspects will now be described, by way of example only, with reference to the accompanying drawings, in which.

DETAILED DESCRIPTION OF THE DRAWINGS

Figure 1:
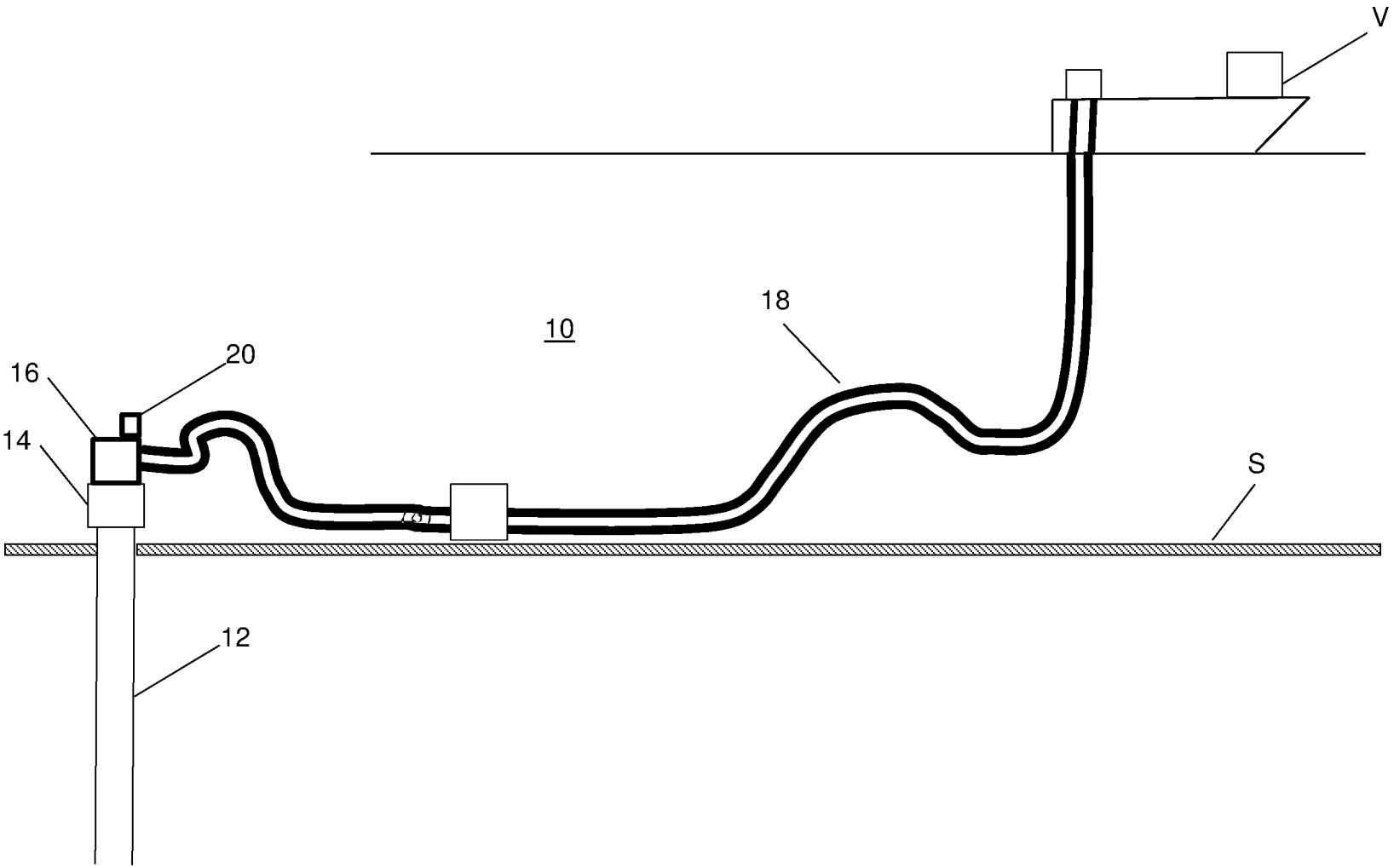
FIG. 1 shows a diagrammatic view of an oil and/or gas wellbore system.

Referring first to FIG. 1 of the accompanying drawings, there is shown a diagrammatic view of an oil and/or gas production system 10. As shown in FIG. 1, the production system 10 takes the form of a subsea production system and comprises a wellbore 12 extending from a wellhead 14 located at the seabed S. A flow control arrangement 16, which in the illustrated wellbore system 10 takes the form of a subsea Christmas tree, is located on the wellhead 14. In use, the flow control arrangement 16 is configured to control production fluid flow and facilitate well isolation. The flow control arrangement 16 also controls access into the production system 10 for tools, equipment, and fluid. A marine riser 18 couples the flow control arrangement 16 to a surface vessel V.

As shown in FIG. 1, the system 10 further comprises a process control system, generally depicted at 20. While the process control system 20 shown in FIG. 1 is shown located on the flow control arrangement 16, it will be understood that the process control system 20, or part of the process control system 20, may be located at a remote location, such as on the seabed, at surface, onshore facility or other suitable location.

Figure 2:
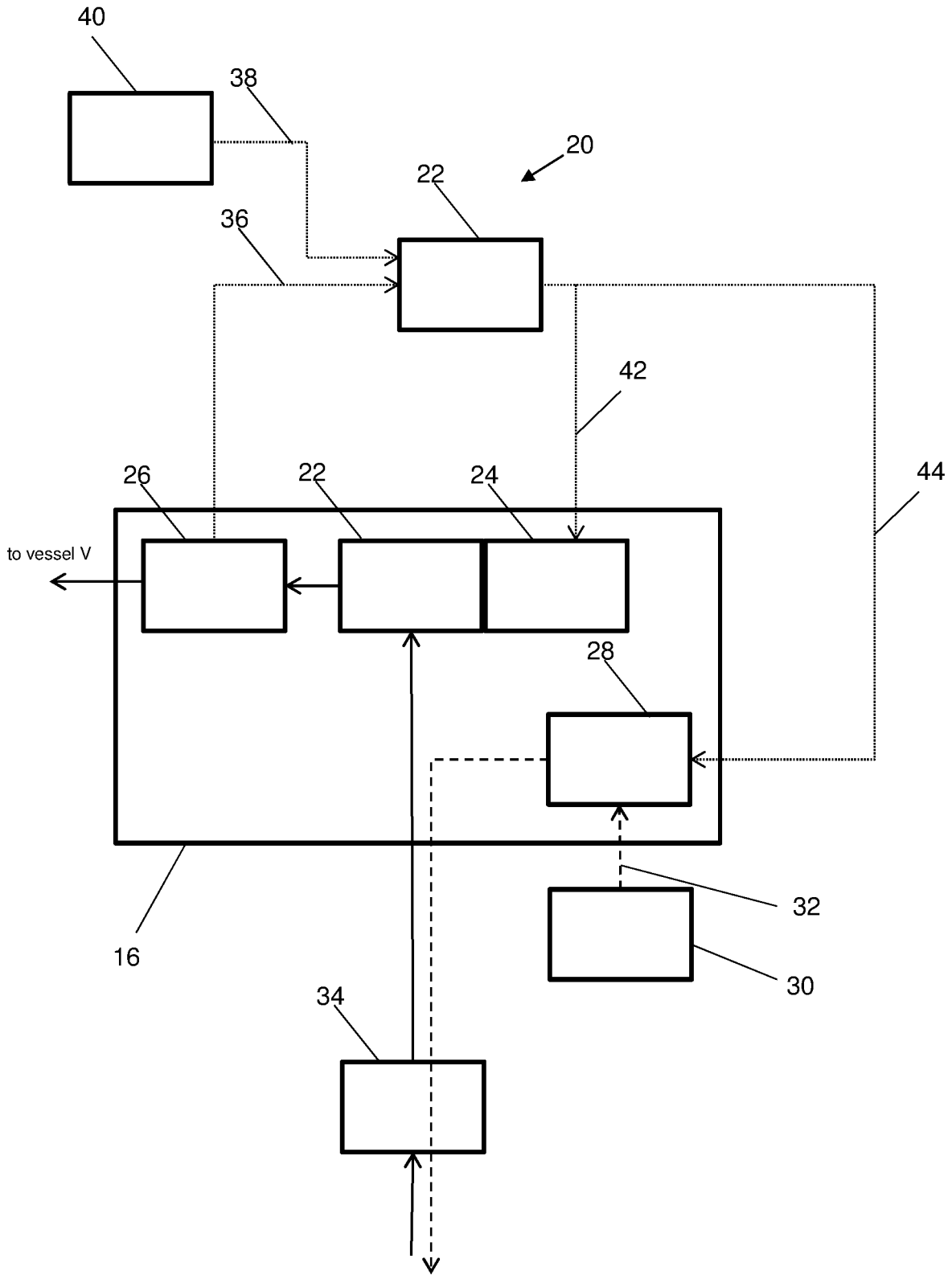
FIG. 2 shows a schematic view of a process control system of the wellbore system shown in FIG. 1.

Referring now also to FIG. 2 of the accompanying drawings, there is shown a schematic view of the part of the system 10 and the process control system 20 in more detail.

As shown in FIG. 2, the flow control arrangement 16 comprises a choke valve 22, a valve actuator arrangement 24, a sensor arrangement 26 and a chemical injection arrangement 28. In the illustrated system 10, the choke valve 22, valve actuator arrangement 24, sensor arrangement 26 and chemical injection valve 28 form part of the flow control arrangement 14, the choke valve 22 and valve actuator 24 taking the form of a DC choke valve and DC valve actuator of the flow control arrangement 14 and the chemical injection valve 28 taking the form of a chemical injection valve of the flow control arrangement 14. As shown in FIG. 2, the chemical injection valve 28 forms part of a chemical injection arrangement and is coupled to a chemical supply 30 via chemical supply line 32.

As shown in FIG. 2, in use production fluid flow (shown by the solid line arrows in FIG. 2) passes through subsurface safety valve 34, choke 22, and sensor arrangement 26 before being transported to surface vessel V via the marine riser 18 (shown in FIG. 1) while the chemical injection arrangement (shown by the dashed line arrows in FIG. 2) is arranged to supply a chemical from the chemical supply 30 to the chemical injection valve 28. In the illustrated system 10, the chemical injection arrangement is configured to inject monoethylene glycol (MEG) in order to mitigate gas hydrate formation. However, it will be recognised that other suitable chemicals may be used where appropriate.

As shown in FIG. 2, the controller 22 of control system 20 is configured to receive an input signal comprising measurement data 36 from the sensor arrangement 26 relating to the production fluid in the wellbore 10. In the illustrated system 10, the controller 22 is also configured to receive data 38 from specialist monitoring, analysis, and/or predictive units, shown collectively at 40. While in the illustrated system 10, the control system 20 is configured to utilise data from specialist monitoring, analysis, and/or predictive units 40, the control system 20 may alternatively utilise data from one or more of these tools.

In use, the controller 22 is configured to determine an adjustment in the configuration of the flow control arrangement 16 from the received data 36, 38 and to provide an output signal indicative of the adjustment in the configuration of the flow control arrangement 16. In the illustrated system 10, the output signal comprises choke control data 42 and chemical metering data 44. As shown in FIG. 2, the choke control data 42 is fed to the valve actuator arrangement 24 while the chemical metering data 44 is fed to the chemical injection valve 28.

Beneficially, embodiments of the system permit operations to be managed more efficiently than conventional techniques and methodologies which rely on manual control. Moreover, embodiments of the system and method may reduce the environmental impact on the surrounding environment, for example by reducing or eliminating the waste due to overuse of chemicals used in gas hydrate management and/or paraffin wax management operations, and the associated equipment footprint.

Figure 3:
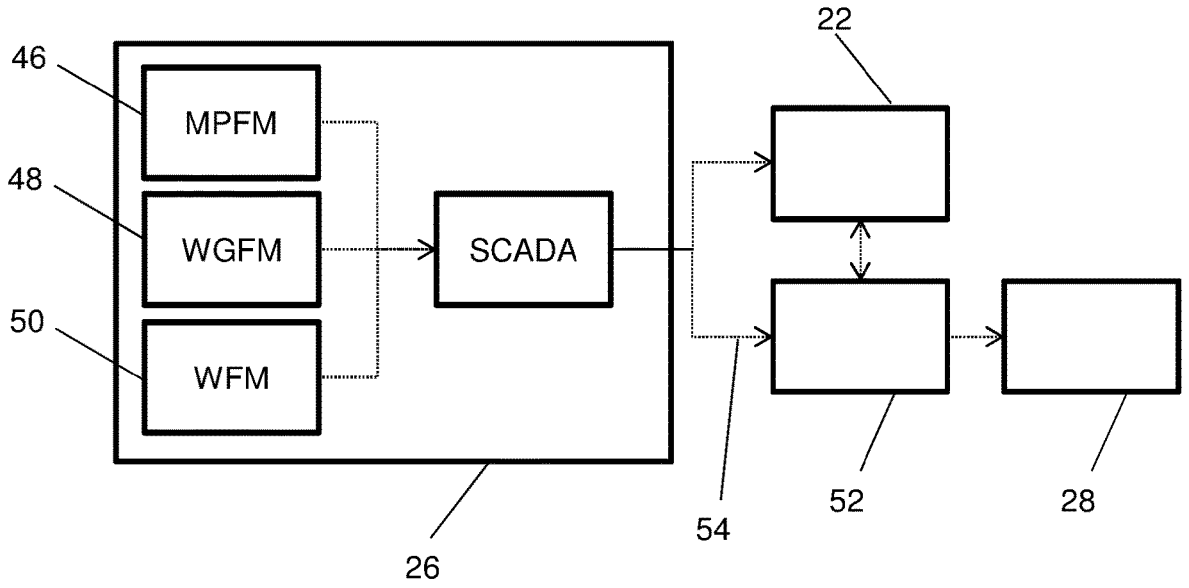
FIG. 3 shows a schematic view of the sensor arrangement of the process control system shown in FIG. 2.

Referring briefly to FIG. 3 of the accompanying drawings, there is shown a schematic view of the sensor arrangement 26 of the process control system 20 shown in FIG. 2 in more detail.

As shown in FIG. 3, the sensor arrangement 26 comprises a SCADA system including a multiphase flowmeter (MPFM) 46, a wet gas flowmeter (WGFM) 48 and a water fraction meter (WFM) 50.

While the illustrated sensor arrangement 26 includes all three of the multiphase flowmeter (MPFM) 46, wet gas flowmeter (WGFM) 48 and water fraction meter (WFM) 50, it will be understood that the sensor arrangement 26 may alternatively comprise one of the multiphase flowmeter (MPFM) 46, wet gas flowmeter (WGFM) 48 and water fraction meter (WFM) 50, and more usually two of the multiphase flowmeter (MPFM) 46, wet gas flowmeter (WGFM) 48 and water fraction meter (WFM) 50 so as to avoid significant cost escalation.

In the illustrated sensor arrangement 26, the multiphase flowmeter 46, wet gas flowmeter 48 and water fraction meter 50 form part of the flow control arrangement 14 and comprise their own hardware and software such as PLCs or the like. As described above, the sensor arrangement 26 communicates with the controller 22. As shown in FIG. 3, the sensor arrangement 26 also communicates with a production operator 52, e.g. via a human machine interface (HMI)—shown schematically at 54. The production operator 52 in turn is capable of communication to/from the controller 22. The control system 20 is thus configured to adjust in response to a control command from an operator. Beneficially, embodiments of the system permit autonomous operation while also permitting manual intervention or override where required.

The control system 20 is capable of operating autonomously, the controller 22 configured to determine the adjustment in the configuration of a flow control arrangement 16 of the production system 10 using an artificial intelligence algorithm.

In use, the control system 20 may, for example, be configured to arrange and organise data, extract patterns and detect trends that are too complex and/or subtle to be detected by humans or by current computerised techniques. The system is capable of automatically devising optimal operational strategies (such as those for hydrate formation prevention) which can either be implemented by the system or passed to a human operator for approval. Moreover, the system is capable of learning operator decisions on the proposed strategies and operator defined changes to any proposed steps, using changes automatically verified as successful to automatically improve the existing strategies. This process may identify human decisions resulting in the deterioration of operating conditions, use this knowledge to avoid such decisions being reused, and flag them to the human decision makers in future operations.

Figure 4:
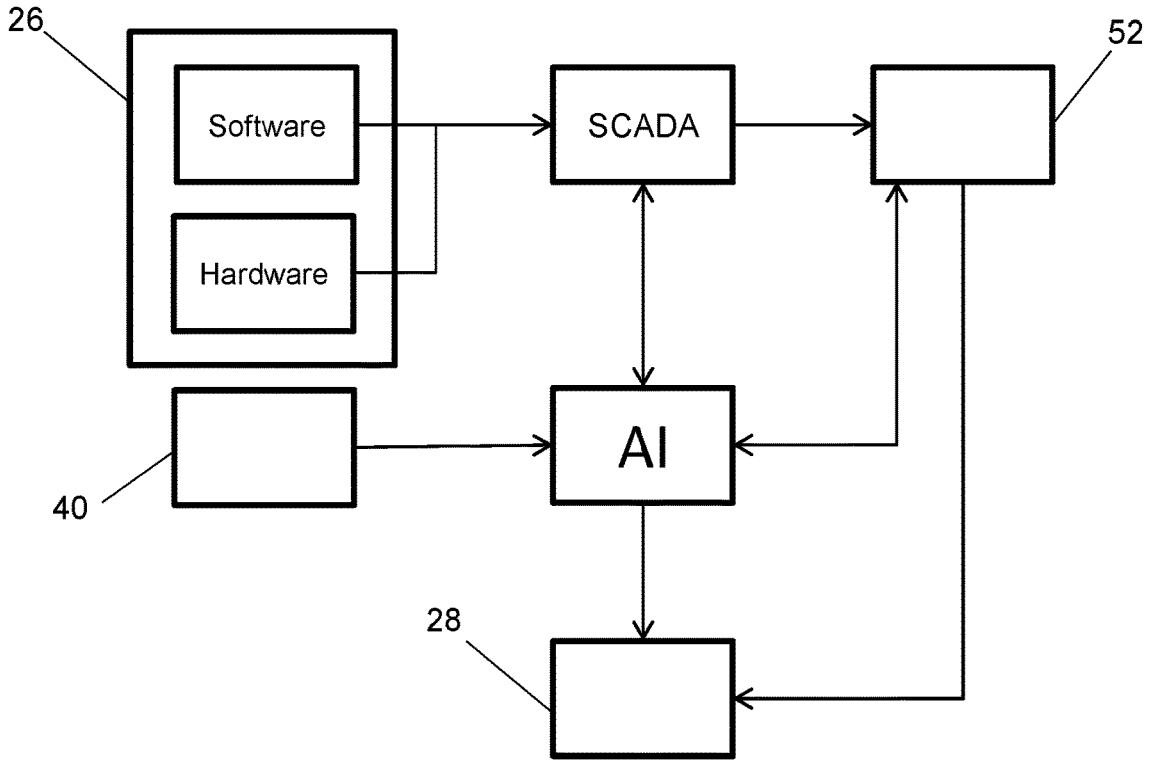
FIG. 4 shows a schematic diagram of the interaction of the AI algorithm with other parts of the process control system.
Figure 5:
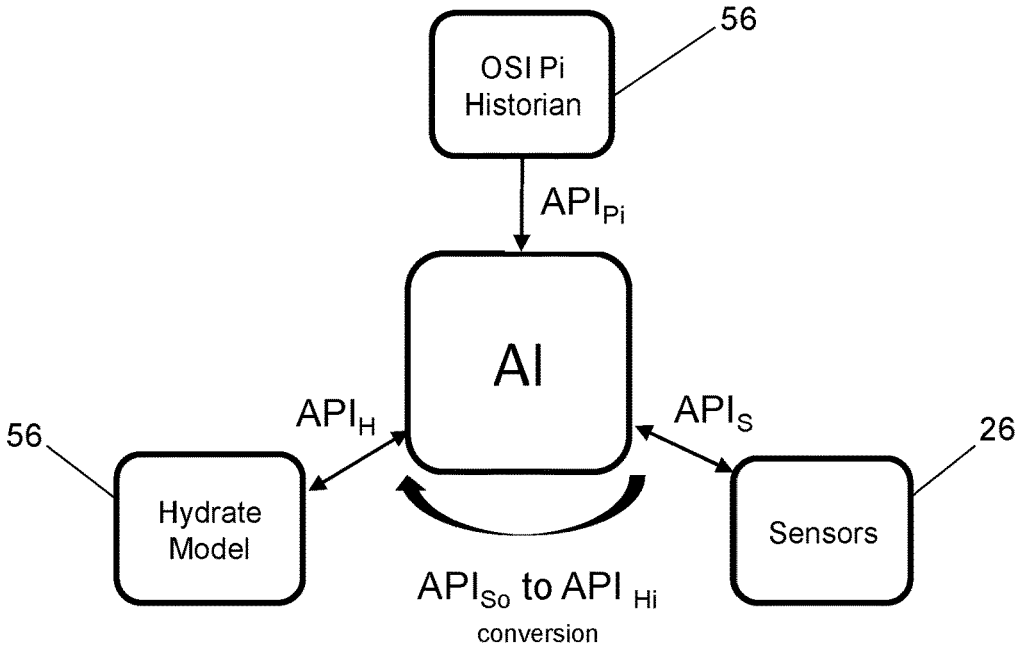
FIG. 5 shows a diagrammatic view of the system integration of the AI algorithm.
Figure 6:
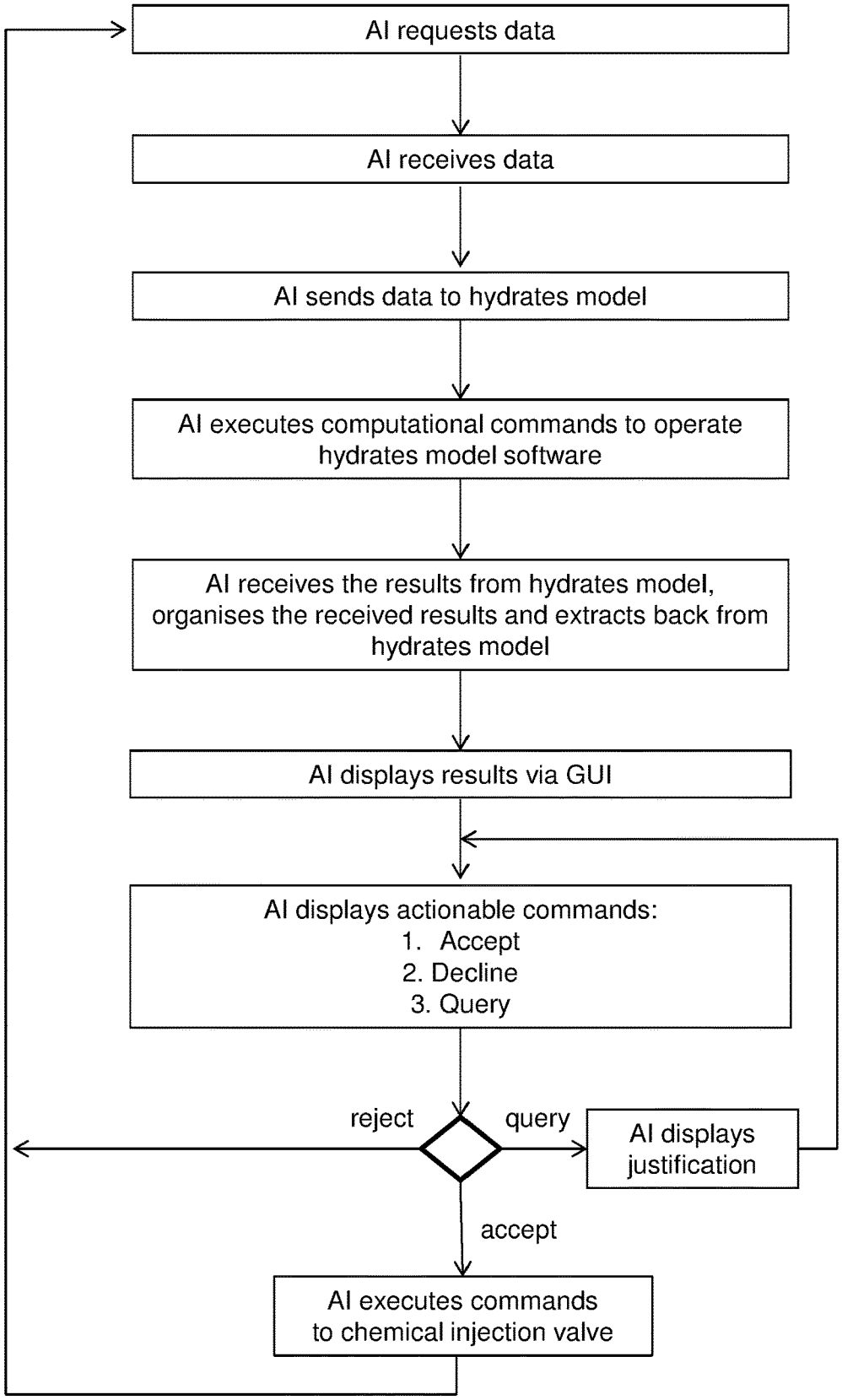
FIG. 6 shows a flowchart illustrating operation of the AI algorithm.

FIGS. 4, 5 and 6 of the accompanying drawings illustrate the configuration and operation of the real-time artificial intelligence algorithm of the system 10.

As shown in FIG. 4, the AI algorithm communicates with sensor arrangement 26 via the SCADA, with specialist monitoring, analysis, and/or predictive units 40, and production operator 52. The AI algorithm also communicates with chemical injection valve 28. The production operator 52 also communicates with the chemical injection valve 28.

As shown in FIG. 5, the AI algorithm is configured to communicate with sensor arrangement 26 via an Application Programming Interface $API_S$ and with OSI Pi historian via Application Programming Interface $API_{Pi}$. The AI algorithm receives and configures the sensor data for input into a hydrate model 56 via Application Programming Interface $API_H$. As will be described below, the AI algorithm receives and converts the data to produce results and a reporting GUI interface.

As shown in FIG. 6, during operation the AI algorithm first requests and receives data, including for example but not exclusively data from the specialist monitoring, analysis, and/or predictive units 40, sensor data from the sensor arrangement 26, such as pressure, temperature, or other data.

Next, the AI sends the data to a hydrates model. The AI then executes the computational commands to operate the software of the hydrates model, organises the received results, and extracts the results back from the hydrates model Next, the AI displays the results via a graphical user interface, together with actionable commands including:

1. Accept;
2. Decline;
3. Suggest action.

On receiving an Accept command, the AI either automatically operates the chemical injection valve to adjust flow rates of the required chemical inhibitor. The AI may alternatively present the command option to the operator to initiate the command to operate the valve.

On receiving a Decline command, no action is initiated.

On receiving a Suggest action command, the AI presents justification for the results presented.

It should be understood that the embodiment described herein is merely exemplary and that various modifications may be made thereto without departing from the scope of the invention.

The controller 22 shall also be able to accommodate a range of specific plug-in data modules such as (but not limited to) those for risk assessments and other production critical operations that can be performed without the reliance of a production operator to manually intervene. The list of plug-in data modules may, for example include: flocculation data; erosion data; corrosion data; CFD data; 5D data; $CO_2$ (geo-sequestration or carbon capture) data; reservoir geology data; reservoir surveillance data, integrated reservoir modelling (static and/or dynamic) data; reservoir data acquisition and conditioning data; reservoir ROI data; risk assessment data; fiscal model data; OpEx/CapEx finance model data, integrated asset modelling data, asset integrity monitoring data, pipeline slugging control data, liquid loading/handling data, well prioritisation data, enhanced predictive operations data; performance monitoring data; process optimisation data; sand production data; salt detection & monitoring data; production balancing management data; choke performance data; RAM optimisation data; safety data; environmental data; optimisation chemical utilisation; HMI reduction data; flow measurement; subsea processing monitoring; remote chemical storage conditioning; inhibitor quality monitoring data; uncertainty modelling data; tree valve condition data; SCM/SEN condition monitoring data; cathodic protection level/balancing data; training data; forecasting data; upset condition modelling data; line packing/unpacking data; steady state/transient monitoring data; diagnostics data; subsea field infrastructure, design, operation, decommissioning data, monitor data; gas composition tracking data; and data analytics.

Amongst other things, the described system and method beneficially provides an integrated system and method for measuring required changes in the concentration of chemicals used for the prevention and/or mitigation of potentially hazardous solids such as gas hydrates, clathrates, paraffin wax and/or asphaltenes, as well as facilitating predictive and/or preventative strategies for these and other materials. Moreover, the system and method also has particular applicability to the fields of gas production and subsea engineering design, glycol regeneration, and/or flow assurance.

The invention claimed is:

1. A process control system for use in an oil and/or gas production, transportation and/or storage system, comprising:

a controller configured to receive an input signal comprising measurement data relating to a production fluid flow in an oil and/or gas production, transportation and/or storage system, the controller configured to determine from the received input signal an adjustment in the configuration of a flow control arrangement of the production wellbore, wherein the controller is configured to provide an output signal indicative of the adjustment in the configuration of the flow control arrangement, and wherein the system comprises, is coupled to, or operatively associated with a choke valve.

2. The process control system of claim 1, wherein the system is configured to mitigate at least one of the formation of gas hydrates and/or the accumulation of paraffin wax, asphaltenes or other solids in an oil and/or gas production, transportation and/or storage system by adjusting the flow control arrangement to vary the injection of a chemical into the production, transportation and/or storage system.

3. The process control system of claim 2, wherein the system is configured to provide an output signal indicative of an adjustment to the flow control arrangement to vary the injection of THI and/or LDHI hydrate inhibitors (methanol or monoethylene glycol (MEG)) into the production, transportation and/or storage system so as to mitigate the formation of gas hydrates.

4. The process control system of claim 2, wherein the system is configured to provide an output signal indicative of an adjustment to the flow control arrangement to vary the injection of a solvent so as to mitigate the accumulation of paraffin wax, asphaltenes and other solids.

5. The process control system of claim 1, wherein the process control system is operatively associated with an oil and/or gas production, transportation and/or storage system comprising at least one of:

a flow line for transporting production fluid;

a riser;

an oil and/or gas production wellbore.

6. The process control system of claim 1, wherein the system is configured to operate autonomously.

7. The process control system of claim 1, wherein the controller is configured to determine the adjustment in the configuration of a flow control arrangement using an artificial intelligence algorithm.

8. The process control system of claim 1, wherein the system is configured to adjust in response to a control command from an operator.

9. The process control system of claim 1, wherein the process control system comprises, is coupled to, or is operatively associated with the flow control arrangement, and wherein optionally the flow control arrangement comprises a production tree.

10. The process control system of claim 1, wherein the input signal comprises measurement data relating to a production fluid flow in an oil and/or gas production, transportation and/or storage system.

11. The process control system of claim 10, wherein the measurement data comprises at least one of:

fluid flow data;

fluid composition data, optionally information relating to the water fraction;

data relating to a condition in the production, transportation and/or storage system and/or the production fluid.

12. The process control system of claim 1, wherein the system comprises, is coupled to, or is operatively associated with, a fluid flow meter, optionally comprising a multi-phase flow meter and/or a wet gas flow meter.

13. The process control system of claim 1, wherein the system comprises, is coupled to, or is operatively associated with a water fraction meter.

14. The process control system of claim 1, comprising or coupled to a sensor arrangement comprising at least one of:

a temperature sensor configured to measure the temperature in the production, transportation and/or storage system and/or the production fluid;

a pressure sensor configured to measure the temperature in the production, transportation and/or storage system and/or the production fluid.

15. The process control system of claim 1, wherein the input signal comprises at least one of:

real time data;

data relating to a simulated condition in the wellbore;

data from manually controlled monitoring systems and equipment;

specialist monitoring, analysis, and/or predictive units.

16. The process control system of claim 1, wherein the input signal comprises data from specialist monitoring, analysis, and/or predictive units, and wherein optionally the controller is configured to determine the adjustment in the configuration of a flow control arrangement of the production and/or transportation system by combining the measurement data with the data from the specialist monitoring, analysis, and predictive units.

17. The process control system of claim 1, wherein the output signal comprises chemical metering data.

18. The process control system of claim 1, wherein the system comprises, is coupled to, or is operatively associated with a chemical injection metering valve (CIMV).

19. The process control system of claim 1, wherein the system comprises, is coupled to or is operatively associated a safety valve.

20. The process control system of claim 19, wherein the safety valve is a subsurface safety valve (SCSV).

21. The process control system of claim 1, wherein the system is configured to communicate data to and/or from a data historian system.

22. An oil and/or gas production, transportation and/or storage system comprising the process control system of claim 1.

23. The process control system of claim 1, wherein the process control system comprises or is coupled to a sensor arrangement, the controller configured to receive the input signal comprising the measurement data from the sensor arrangement.

24. The process control system of claim 1, wherein the sensor arrangement forms part of the flow control arrangement.

25. The process control system of claim 1, wherein the choke valve is a DC choke valve.

26. The process control system of claim 1, wherein the process control system comprises, is coupled to or is operatively associated with an actuator arrangement configured to operate the choke valve.

27. A process control system for use in an oil and/or gas production, transportation and/or storage system, wherein the system comprises, is coupled to, or is operatively associated with a chemical injection arrangement, and wherein the process control system comprises:

a controller configured to receive an input signal comprising measurement data relating to a production fluid flow in an oil and/or gas production, transportation and/or storage system, wherein the controller is configured to determine from the received input signal an adjustment in the configuration of a flow control arrangement of the production wellbore, wherein the controller is configured to provide an output signal indicative of the adjustment in the configuration of the flow control arrangement, and, wherein the output signal comprises choke control data.

28. The process control system of claim 27, wherein the chemical injection arrangement comprises at least one of:

one or more flow line; and, a chemical store.

29. A process control system for use in an oil and/or gas production, transportation and/or storage system, wherein the process control system comprises, is coupled to, or is operatively associated with a flow control arrangement of a production wellbore of the oil and/or gas production, transportation and/or storage system, the process control system configured to mitigate at least one of the formation of gas hydrates and/or the accumulation of paraffin wax, asphaltenes or other solids in the oil and/or gas production, transportation and/or storage system by providing an output signal indicative of an adjustment in the configuration of the flow control arrangement so as to vary the injection of a chemical into the production, transportation and/or storage system, and, wherein the process control system comprises, is coupled to, or operatively associated with a choke valve and a chemical injection metering valve of the flow control arrangement, and comprises:

a controller configured to:

receive an input signal comprising measurement data relating to a production fluid flow in the oil and/or gas production, transportation and/or storage system;

determine from the received input signal an adjustment in the configuration of the flow control arrangement, wherein the controller is configured to determine the adjustment in the configuration of the flow control arrangement using an artificial intelligence algorithm; and provide the output signal indicative of the adjustment in the configuration of the flow control arrangement, wherein the output signal indicative of the adjustment in the configuration of the flow control arrangement comprises chemical metering data to be fed to the chemical injection metering valve of the flow control arrangement, and wherein the output signal indicative of the adjustment in the configuration of the flow control arrangement comprises choke control data to be fed to an actuator arrangement configured to control the choke valve.

* * * * *